United States Patent [19]

Kawano et al.

[11] Patent Number: 4,741,240

[45] Date of Patent: May 3, 1988

[54] RECORDER

[75] Inventors: Shūhei Kawano; Yuko Yamada; Masaaki Mizuguchi; Akihiko Takeuchi, all of Hamamatsu, Japan

[73] Assignee: Nippon Gakki Seizo Kabushiki Kaisha, Japan

[21] Appl. No.: 931,074

[22] Filed: Nov. 17, 1986

[30] Foreign Application Priority Data

| | | | |
|---|---|---|---|
| Nov. 20, 1985 | [JP] | Japan | 60-260390 |
| Nov. 20, 1985 | [JP] | Japan | 60-260391 |
| Nov. 20, 1985 | [JP] | Japan | 60-260392 |
| Nov. 20, 1985 | [JP] | Japan | 60-178962[U] |
| Nov. 20, 1985 | [JP] | Japan | 60-178963[U] |

[51] Int. Cl.[4] ..... G10D 7/02

[52] U.S. Cl. ..... 84/380 C; 84/1.04

[58] Field of Search ..... 84/1.04, 1.06, 1.15, 84/380, 384, 453

[56] References Cited

U.S. PATENT DOCUMENTS

| | | | |
|---|---|---|---|
| 2,984,140 | 5/1961 | Barron | 84/1.04 |
| 3,421,401 | 1/1969 | Lichtenstein | 84/453 |
| 3,543,629 | 12/1970 | Barcus | 84/1.14 |
| 3,643,538 | 2/1972 | Toyama | 84/384 |

*Primary Examiner*—Lawrence R. Franklin

*Attorney, Agent, or Firm*—Ostrolenk, Faber, Gerb & Soffen

[57] ABSTRACT

In construction of a musical recorder, a sound collector such as a microphone is attached to the body of the recorder at the position of the constant belly of the basic vibration of resonant air columns formed in the bore of the recorder at musical tone generation in order to obtain constant sound collecting level with large howling margin at musical tone regeneration without any influence of the wall configuration of the bore.

11 Claims, 5 Drawing Sheets

RECORDER

BACKGROUND OF THE INVENTION

The present invention relates to an improved recorder, and more particularly relates to improvement in sound generating ability of a recorder provided with an attached sound collector.

The term "sound collector" used herein generally refers to a device which responds to vibration of a sound and generates a corresponding electric output signal, i.e. most typically a microphone.

In general, a conventional recorder takes the form of an elongated tube which is made up of a head joint, a middle joint and a foot joint coupled to each other at corresponding longitudinal ends.

The head joint includes a tubular main body and a fipple coupled to the upper end of the main body. A wind-way is formed through the fipple in communication with the bore of the main body. Near the lower end of the wind-way an open window is formed also in communication with the bore. Facing the lower end of the wind-way, a sharp edge projects into the window. With this construction, air blown out of the wind-way collides against the edge and a part of the air flows into the bore of the main body.

The middle joint has a bore open at both longitudinal ends and a plurality of aligned sound holes formed in communication with the bore. The foot joint also has a bore open in both longitudinal ends.

Air blown through the wind-way causes vibration of an air column whose length is determined by the distance between the window and the first open sound hole or holes. This vibration of the air column generates a corresponding musical tone which is emanated outwards through the window and the open sound hole or holes.

When a recorder is played within a small room, the audience can enjoy musical tones directly generated by the recorder. When performance is carried out in a large room or out doors, it is necessary to collect musical tones generated by the recorder by a proper sound collector, e.g. a microphone, and regenerate the tones using a sound system after proper amplification. For example, such a microphone is set at a prescribed distance from the recorder and sound waves from the window and the open sound hole or holes are collected by the microphone which amplifies the collected sound waves to form electric signals corresponding to the musical tones generated by the recorder. The electric signals are passed to a sound system for regeneration of corresponding amplified musical tones.

With such a system, there is no problem as long as the relative position between the recorder and the sound collector always remains unchanged. In practice, however, the player often moves the recorder in order to get in the swing of his performance. Such movement of the recorder changes the distance between the window of the recorder as well as the sound holes and the sound collector and, when repeated at random, the relative position between them fluctuates randomly. Such random fluctuation in relative position causes interference of sound waves from different sound holes of the recorder. The resulting change in sound collectng level at the sound collector seriously disturbs the correspondence in tone volume between the musical tones generated by the recorder and the musical tones regenerated by the sound system connected to the sound collector.

In addition, the damping of sound waves during transmission greatly lowers the sound pressure at the sound collector and amplification of the damped sound-waves makes the sound system extremely prone to howling.

Such troubles are basically caused by the fact that the sound collector is located a distance from the recorder. From this point of view, it is possible to mount a sound collector directly to the recorder itself. In practice, however, this expedient may be employed with a flute free of trouble but not with a recorder.

A flute generally takes the form of an elongated tube which is made up of a head joint, a middle joint and a foot joint connected to each other at their longitudinal ends. The top end of the head joint is plugged with a slidable reflector plate and a blow hole is formed at a position which is a prescribed distance from the reflector plate. The middle joint is provided with a plurality of aligned sound holes. With this construction, the capacity of a cavity left between the reflector and the blow hole is variable depending on the position of reflector plate and the effective length of the air column in the tube is defined by the distance between the reflector plate and the blow hole as reported by A. H. Benade et al in "Journal of Acoustical Society of America" Vol 37, P67~(1965). Due to this mechanism of sound vibration, the position of the reflector plate poses little influence on the tonal pitch of a sound to be generated. As a consequence, it is easy to arrange a sound collector in the above-described cavity of a flute.

In contrast, a recorder is not provided with such a cavity which has a small influence on tonal pitch. In the case of a recorder, the effective length of an air column is defined by the dimensions of the lower end of the fipple and the inner wall of the head joint. As a consequence, the configuration of the inner wall has a serious affect on the tonal pitch of a musical tone to be generated. Providing a sound collector internally of the recorder changes the original configuration of the inner wall and, as a consequence, tends to mar tonal quality of the musical tones to be generated.

SUMMARY OF THE INVENTION

It is the basic object of the present invention to enable direct attachment of a sound collector to a recorder while assuring constant sound collecting level and large howling margin.

In accordance with the basic aspect of the present invention, a sound collector is attached to the body of a recorder in the vicinity of the window.

DESCRIPTION OF THE PREFERRED EMBODIMENTS

Figure 1:
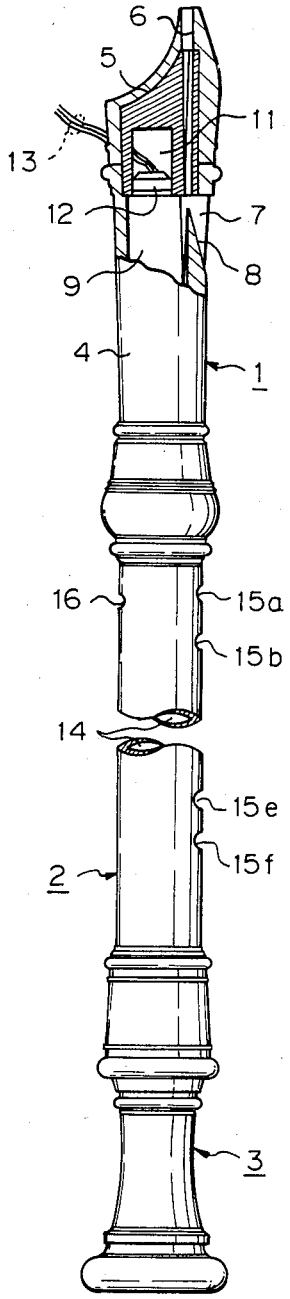
FIG. 1 is a side view, partly in section, of one embodiment of the recorder in accordance with the present invention.

FIG. 1 depicts one embodiment of the recorder in accordance with the present invention, in which a built-in microphone 12 is used for the sound collector. Like a conventional recorder, the recorder of FIG. 1 is made up of a head joint 1, a middle joint 2 and a foot joint 3 coupled to each other at their longitudinal ends. The head joint 1 includes a tubular main body 4 and a fipple 5 coupled to the upper end of the main body 4. The fipple 5 is combined with a small piece having a top longitudinal groove to provide a wind-way 6. As an alternative, the fipple 5 and the small piece may be formed in one body having a longitudinal bore providing the wind-way 6. A radially open window 7 is formed near the lower end of the wind-way 6, in the main body 4 in communication with a bore 9. A sharp edge 8 extends into the window 7 towards the lower end of the wind-way 6. A cavity 11 is formed in the fipple 5 substantially in line with the bore 9 in the main body 4 and the microphone 12 is accommodated in the cavity 11 in the fipple 5 with its sound collecting face substantially flush with the lower end of the fipple 5. Thus the sound collecting face of the microphone 12 is directly exposed in the bore 9 of the main body 4 in which vibratory air columns are formed. The microphone 12 is electrically connected to an outside sound system (not shown) via a lead wire 13.

The middle joint 2 is provided with a bore 14, a plurality of sound holes 15*a* to 15*f* in communication with the bore 14 and a thumb hole 16. The foot joint 3 is also provided with a bore.

When the three joints 1 to 3 are coupled to each other, the bores of these joints are placed in substantially straight communication and an air column is formed in the bores having one end at the position of the window 7 in the head joint 1 and the other end at the position of one of the sound holes or the lower end of the foot joint 3.

The recorder operates as follows. When played in a relatively small room, the lead wire 13 of the microphone 12 is disconnected from the sound system. The air flow from the wind-way 6 collides against the edge 8 and a part of the air flows into the bores to cause resonance of the air column. Musical tones generated through such air column resonance are emanated outwards via the window 7 and an open sound hole but not collected by the microphone 12.

Figure 3A:
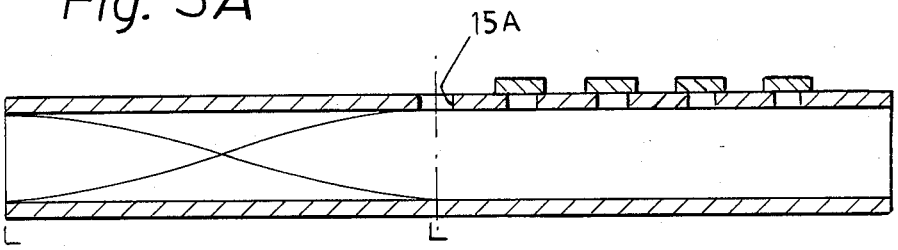
FIGS. 3A and 3B are sectional side views for showing sound vibrating mechanism on a recorder.
Figure 3B:
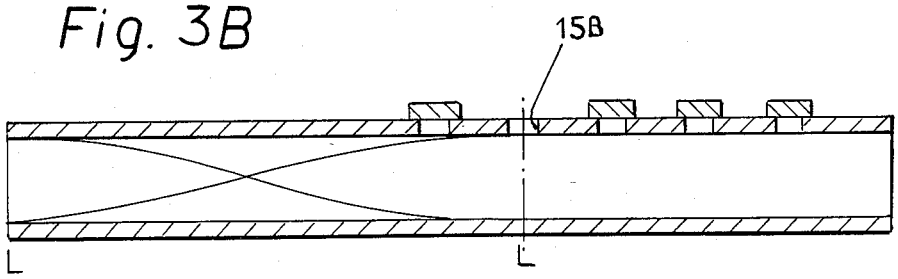

When played in a relatively large room or out doors, the lead wire of the microphone 12 is connected to a sound system. Vibration of the air column includes a basic frequency tone and its harmonic tones which corresponds to the effective length between the window 7 and the first open sound hole. In the case of the vibration shown in FIG. 3A, only the sound hole closest to the window 7 is left open (the shaded rectangles represent a players fingers). The basic vibration of the resonant air column formed in the bores has its belly L (i.e., the point of maximum vibration) at the positions of the window 7 and the open sound hole. In the case of the vibration shown in FIG. 3B, only the sound hole second closest to the window 7 is left open (the shaded rectangles represent a players fingers). The basic vibration of the resonant air column formed in the bore has its belly L again at the position of the window 7 and the open sound hole. Thus, despite a change in the position of the open sound hole, one belly of the resonant air column is always located at the position of the window. As a consequence, the presence, of the cavity 11 and the microphone 12 placed therein has a similar influence on all musical tones to be generated. Thus, the recorder in accordance with the present invention enables generation of musical tones of uniform tonal quality without any adverse influence of the presence of the cavity 11 and the microphone 12.

Musical tones sequentially generated by the recorder are collected by the microphone 12 for regeneration by the sound system after proper amplification. Since the musical tones are collected directly from the resonant air columns in the bores, high sound pressure assures large howling margin at regeneration by the sound system. Further, the direct collection in the bore removes interference by sound waves emanated outwards via the window 7 and the open sound holes, thereby assuring beautiful regeneration by the sound system.

Figure 2:
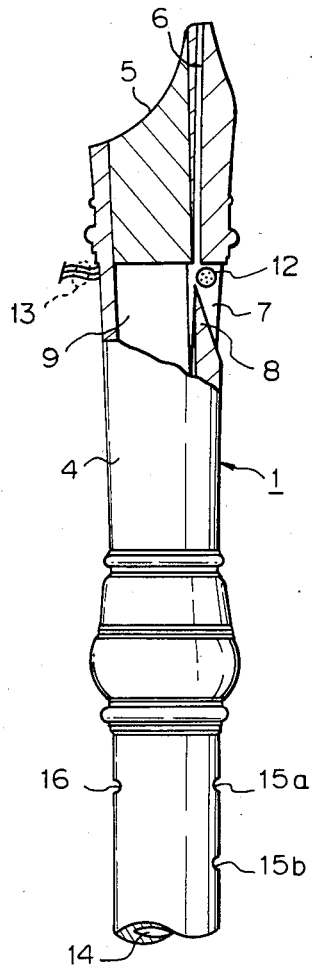
FIG. 2 is a side view, partly in section, of the main part of another embodiment of the recorder in accordance with the present invention.

Another embodiment of the recorder in accordance with the present invention is shown in FIG. 2, in which the fipple 5 has no cavity and the microphone 12 is arranged on the inner side wall of the window 7. In this case again, sound collection is carried out at the position of the constant belly L of the resonant air column.

As a substitute for a microphone, the sound collector may take the form of a piezoelectric element or a proper sensor capable of quantitatively detecting physical values relating to resonant air columns formed in the bore of the recorder.

In the case of the foregoing embodiments, the sound collector is directly mounted to the main body 4 of the head joint 1 at the position of the cavity 11 in the fipple 5 or the window 7. With such a direct mounting, solid vibrations caused by players fingers closing and opening the sound holes are transmitted to the sound collector via the head joint 1 and such solid vibrations tend to be collected by the sound collector in the form of noises. In addition, inadvertent if the recorder is accidentally dropped on the floor an impulsive force is transmitted to the sound collector causing its breakage. Further, humid breath of the player tends to cause corrosion of the sound collector.

Figure 4:
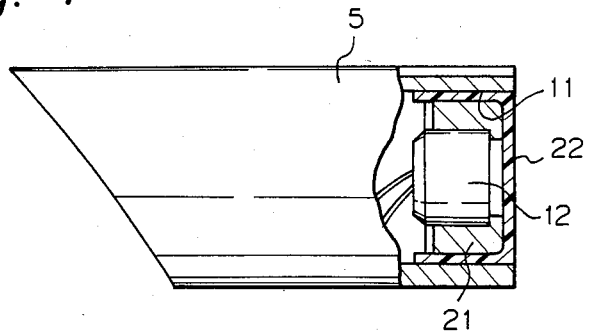
FIG. 4 is a side view, partly in section, of the main part of another embodiment of the recorder in accordance with the present invention.

Another embodiment of the recorder of the present invention shown in FIG. 4 is designed to remove such noise and humidity problems. In this case, the microphone 12 is again placed in the cavity 11 of the fipple 5. With the exception of the sound collecting face and the rear face, the microphone 12 is attached to the wall of the cavity 11 by means of a shock absorber 21 and the sound collecting face of the microphone 12 is covered with a moisture repellent sheet 22. The shock absorber 21 is made of an elastic synthetic resin such as polyurethane and the moisture repelent sheet 22 is made of a synthetic resin such as polyethylene.

Due to presence of the shock absorber 21, any vibration from the head joint 1 is greatly attenuated virtually without any transmission to the microphone 12. Further the moisture repellent sheet 22 does not allow virtually any moisture from the player's breath to reach the microphone 12.

In an alternative embodiment, the shock absorber 21 and the moisture repellent sheet 22 may be made in one body of a shock absorbent and moisture repellent synthetic resin material.

Figure 5:
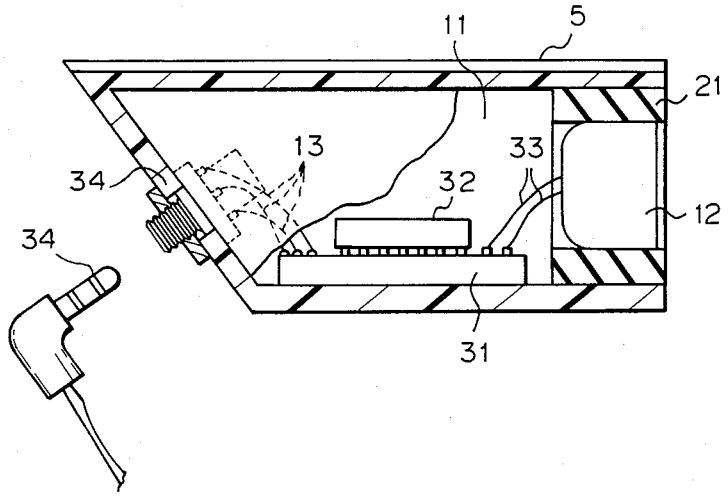
FIG. 5 is a side sectional view of the main part of the embodiment of the recorder in accordance with the present invention.

Yet another embodiment of the recorder in accordance with the present invention is shown in FIG. 5, in which a microphone is accompanied with a built-in electric circuit for adjusting tone range of musical tones to be regenerated. More specifically, as in the foregoing example, the microphone 12 is arranged in the cavity 11 of the fipple 5 via a shock absorber 21. Further, a substrate 31, made of insulating material, is fixed to the wall of the cavity 11 above the microphone 12. This substrate 31 includes a prescribed conductive pattern on its surface. Pins of a semiconductor unit 32 are inserted into the conductive pattern on the substrate so that the microphone 12 is connected to the semiconductor unit 32 via the pins, the conductive pattern and lead wires 33. The conductive pattern on the substrate 31 is selectively connected to a sound system (not shown) via the lead wire 13 and a connector 34. The semiconductor unit 32, the lead wires 13 and 33 and the connector 34 form the main part of the electric circuit in accordance with this embodiment. The semiconductor unit 32 includes an integrated octave shifting circuit which shifts octave of musical tones given in the form of electric signals produced by the microphone 12. So, by preparing a plurality of fipples 5 having semiconductor units 32 of different octaves, the tonal range of the musical tones to be regenerated can be adjusted as desired.

As an alternative for the above-described octave shifting circuit, the semiconductor unit 32 may include a circuit which converts analog electric signals from the microphone 12 into digital signals shift the pitch of the digital signals and a gain converts the digital signals into analog signals for transmission to the sound system. The semiconductor may include a circuit which changes tone color of the musical tones in the form of electric signals from the microphone 12. When a proper transmitter is used instead of the connector 34, a wireless connection can be established between the microphone 12 and the sound system.

In the case of some embodiments of the recorder in accordance with the present invention, the sound collector is located near the window 7 facing the edge 8 as best seen in FIG. 1. When air flow from the wind-way 6 collides against the edge 8, there is generated a high frequency sound which is called an edge tone and the sound collector picks up this edge tone as a noise.

Figure 6:
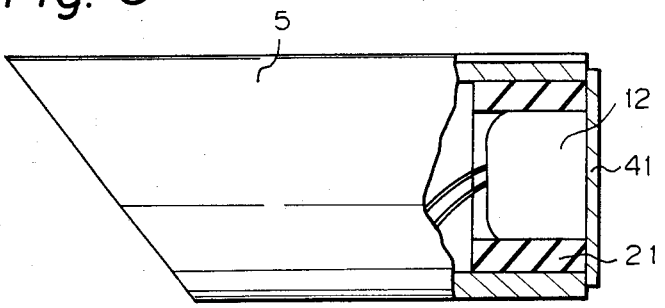
FIG. 6 is a side view, partly in section, of the main part of another embodiment of the recorder in accordance with the present invention.

The embodiment of the recorder shown in FIG. 6 is provided with means for removing such edge tones. More specifically, the sound collecting face of the microphone is covered with a sound absorber 41 which is capable of absorbing high frequency sounds. Most typically, the sound absorber 41 is made of a non-woven fabric. Alternatively, the sound absorber 41 may be made of sponge rubber.

We claim:

1. An improved recorder, comprising:

(A) an elongated tube having a bore formed therein, said bore being open at one end of said tube and closed at the other end of said tube, a wind-way formed at said other end of said tube in communication with said bore, a radially open window formed in the vicinity of said wind-way in communication with said bore and a plurality of aligned sound holes in communication with said bore, and (B) sound sensing means located internally of said tube at said other end of said tube and adjacent said bore for sensing the vibrations in said bore and producing electrical signals as a function thereof.

2. An improved recorder as claimed in claim 1 in which:

said wind-way is formed in a fipple coupled to said other end of said tube;

said fipple is provided with a cavity formed in communication with said bore in said tube; and said sound sensing means is accommodated in said cavity of said fipple with its sound sensing face facing said bore in said tube.

3. An improved recorder as claimed in claim 2 in which said sound sensing means is coupled to the wall of said cavity of said fipple via a shock absorber.

4. An improved recorder as claimed in claim 2 or 3 in which said sound sensing face of said sound sensing means is covered with a moisture repellent sheet.

5. An improved recorder as claimed in claim 2 or 3 in which said sound sensing face of said sound sensing means is covered with a sound absorber which is capable of absorbing high frequency sounds.

6. An improved recorder as claimed in claim 2 or 3 further comprising a semiconductor unit arranged within said cavity of said fipple and connecting said sound sensing means to said sound system.

7. An improved recorder as claimed in claim 6 in which said semiconductor unit includes an octave shifting circuit.

8. An improved recorder as claimed in claim 6 in which said semiconductor unit includes a pitch shifting circuit.

9. An improved recorder as claimed in claim 6 in which said semiconductor unit includes a tone color shiftng circuit.

10. An improved recorder as claimed in claim 1 in which said sound sensing means is mounted to the wall of said window.

11. An improved recorder as claimed in claim 1, wherein said bore defines a resonating cavity and wherein said sound sensing means is located externally of said resonating cavity.

* * * * *